US006722761B2

(12) United States Patent
Asano et al.

(10) Patent No.: US 6,722,761 B2
(45) Date of Patent: Apr. 20, 2004

(54) INKJET RECORDING HEAD AND INKJET RECORDING DEVICE

(75) Inventors: Shinya Asano, Tokyo (JP); Yukuo Yamaguchi, Tokyo (JP); Tetsuya Ishikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/190,684

(22) Filed: Jul. 9, 2002

(65) Prior Publication Data

US 2003/0007046 A1 Jan. 9, 2003

(30) Foreign Application Priority Data

Jul. 9, 2001 (JP) ..... 2001-208409

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS 5,233,369 A * 8/1993 Carlotta et al. ..... 347/87
5,903,294 A * 5/1999 Abe et al. ..... 347/87
5,905,518 A * 5/1999 DeFilippis ..... 347/29
5,984,460 A * 11/1999 Takagi et al. ..... 347/86
6,022,102 A * 2/2000 Ikkatai et al. ..... 347/85

FOREIGN PATENT DOCUMENTS

EP 846561 6/1998
EP 1146706 10/2001

* cited by examiner

*Primary Examiner*—Anh T. N. Vo
(74) *Attorney, Agent, or Firm*—Fitzpatrick, Cella, Harper and Scinto

(57) ABSTRACT

An inkjet recording device including a tank incorporated inside an inkjet recording head and divided into a large-capacity main chamber and first and second vertically-arranged needle-receiving chambers. Each needle-receiving chamber includes a connecting hole for communication with the main chamber and an opening for receiving a needle. First and second needles that pass through corresponding first and second resilient joints that seal the opening are inserted into the corresponding first and second needle-receiving chambers. The upper first needle is connected to a pump for discharging air through a first tube, and the lower second needle is connected to a main tank for supplying ink through a second tube. In each needle-receiving chamber, the connecting hole is positioned above the opening, and/or the connecting hole is made small. When the connecting hole is above the opening, the inkjet recording device reduces the tendency of ink to solidify near holes of the needles used to supply ink. When the connecting hole is small, an ink meniscus is formed in the connecting hole, which likewise reduces the tendency of the ink to solidify.

20 Claims, 8 Drawing Sheets

INKJET RECORDING HEAD AND INKJET RECORDING DEVICE

BACKGROUND OF THE INVENTION

1. Field of the Invention

The present invention relates to an inkjet recording head which incorporates a tank for containing ink, and an inkjet recording device including ink supplying means for supplying ink to the inkjet recording head through a needle.

2. Description of the Related Art

Image recording devices are used in diverse applications, for example, printers, copying machines, or facsimile machines, or recording devices used as output devices of composite electronic devices (including, for example, computers or word processors), or as output devices of workstations. These recording devices are constructed so as to record an image (including characters, drawings, designs, etc.) on a recording material (recording medium) such as paper or a thin plastic plate, with the image being recorded based on image information. One form of such a recording device for forming an image on a recording medium is an inkjet recording device which discharges very small ink droplets from a very small ink-discharge nozzle or opening. In general, an inkjet recording head of the inkjet recording device comprises a recording head body which includes an ink-discharge nozzle or nozzles for discharging ink droplets and a tank for containing ink supplied to the recording head body. The ink is guided from the tank to the recording head body. An energy generating member, such as a heat-generating element or a piezoelectric element, disposed close to the ink-discharge nozzle is driven based on a recording signal, causing ink droplets to be discharged from the ink-discharge nozzle and to stick onto the recording medium, whereby a recording operation is carried out. The inkjet recording device is what is called a nonimpact recording device, and has the advantages of, for example, being capable of performing a recording operation with high speed and on various types of recording media and producing almost no noise during the recording operation. Accordingly the inkjet recording device is widely used.

Among the different types of inkjet recording devices, a bubblejet-type inkjet recording head which discharges ink using heat energy can perform a recording operation with high resolution because its ink-discharge nozzles for discharging ink can be disposed very close to each other. In particular, a bubblejet-type inkjet recording head which uses an electrothermal converting member as an energy-generating source can easily be made more compact. In addition, the advantages of integrated circuit (IC) technology and micro-fabrication technology, which have improved considerably and which have become very reliable in the semiconductor field in recent years, can satisfactorily be made use of, so that high-density mounting can be easily achieved, thereby causing the bubblejet-type inkjet recording head to be advantageous from the viewpoint of low manufacturing costs.

Many methods of supplying ink to the tank of the inkjet recording head, such as an on-carriage tank method, a pit-in method, and a continuous supplying method using a tube, have been proposed. Among these methods, the continuous supplying method using a tube is primarily used in large recording devices and business recording devices because the capacity of the tank incorporated in the inkjet recording head can easily be made large, running cost is low, and the tank does not need to be frequently replaced.

As mentioned above, the inkjet recording head of such an inkjet recording device comprises a recording head body (discharge unit) and a tank for storing ink. Ink in a main tank that is fixedly provided at the recording device body is supplied to the tank (which is hermetically sealed) of the inkjet recording head through a tube. From this tank, the ink is supplied to the recording head body disposed downstream from the tank.

When the inkjet recording device is constructed in this way, since the tube and the tank are hermetically sealed except from the main tank, if, for example, no air bubbles are produced due to ink discharge or expansion or coagulation of dissolved air inside the tank of the inkjet recording head, an amount of ink which is the same as the amount of ink discharged is automatically supplied from the main tank to the tank of the inkjet recording head.

However, even a very small amount of air mixed in the ink gradually accumulates over time, and very small amounts of air can pass through, for example, the wall of the tube and gradually accumulate in the entire ink path. Therefore, the amount of air in the tank of the inkjet recording head increases over time, causing the amount of ink in the tank to gradually decrease. When the amount of ink in the tank decreases in this way, it is necessary to forcefully supply ink by, for example, suction generating means.

Here, the most generally used means for forcefully supplying ink supplies ink by providing a pressure difference between the main tank and the tank of the inkjet recording head by generating negative pressure in the tank by a suction generating device such as a pump. In other words, as shown in FIGS. 8A and 8B, a total of two tubes, a tube 114 for supplying ink 128 from a main tank 116 and a tube 115 connected to a suction generating device, such as a pump 117, are connected to one tank 111.

Although there are slight differences depending upon the frequency with which the inkjet recording head 101 is replaced, connecting means used in the structure shown in FIGS. 8A and 8B is generally and optimally constructed by providing openings 119 and 120 in the tank 111 of the inkjet recording head 101 and by closing the openings 119 and 120 by corresponding resilient joints 121 and 122, such as rubber plugs; and by mounting hollow needles 112 and 113 to ends of the corresponding tubes 114 and 115 and by passing the needles 112 and 113 through the corresponding resilient joints 121 and 122 and inserting them into the tank 111. The connecting means does not cause the ink 128 to drip even if there is a small amount of ink remaining inside the tank 111 when the inkjet recording head 101 is replaced. Therefore, in the connected state, the connecting means can reliably seal the tank 111 in order to construct an ink supply path with no ink leaks, thereby providing various advantages such as a simplified structure.

In the structure for supplying the ink 128 to the inkjet recording head 101, a carriage (not shown) which holds the inkjet recording head 101 is provided. The two hollow needles 112 and 113 are arranged vertically at a fixed position relative to the carriage. Holes 112*a* and 113*a* are formed in ends of or side surfaces near the ends of the corresponding needles 112 and 113. The upper needle 113 is connected to the pump 117 through the tube 115, and is constructed so that it can suck air in the tank 111 of the inkjet recording head 101 by operation of the pump 117. The lower needle 112 is connected to the main tank 116 through the tube 114, and is constructed so that it can supply the ink 128 in the main tank 116 into the tank 111 of the inkjet recording head 101. Therefore, by the pump 117, the air in the tank 111 of the inkjet recording head 101 is sucked through the tube 115 and the upper needle 113. In addition, the ink 128 is supplied into the tank 111 from the main tank 116 through the other tube 114 and the lower needle 112.

A mechanism for holding and securing the inkjet recording head 101 is provided at the carriage (not shown). By operating a carriage head lever, this mechanism can secure the inkjet recording head 101 to the carriage, and can allow removal of the inkjet recording head 101 from the carriage.

A mechanism for passing the two needles 112 and 113 through the resilient joints 121 and 122 of the inkjet recording head 101 and inserting them into the tank 111 is provided at the carriage. This mechanism may move in response to movement of the carriage head lever.

The least expensive method of detecting a timing of stopping an ink filling operation from the start of the ink filling operation is to stop the ink filling operation after a certain time from the start of the ink filling operation or after a certain amount of ink has been supplied. A more reliable method is to provide a special-purpose ink level sensor (not shown) inside the tank 111 and to stop the supplying of ink when the ink level reaches a certain height.

In the above-described related structure, the needles 112 and 113 are inserted into the tank 111 of the inkjet recording head 101 secured to the carriage. As shown in FIG. 8B, when the amount of ink inside the tank 111 of the inkjet recording head 101 becomes small, the amount of ink 128 around the needles 112 and 113 becomes small, so that the needles 112 and 113 are exposed to the air inside the tank 111. However, residual ink adheres to and remains on the outer peripheral portions of the needles 112 and 113 and the inside portions of the holes 112*a* and 113*a*, so that, when the needles are exposed to the air, the residual ink gradually hardens, causing the holes 112*a* and 113*a* of the corresponding needles to become clogged. When this occurs, the air inside the inkjet recording head 101 cannot be sucked and the ink 128 cannot be supplied through the needles 112 and 113. When recording operations are continued without any ink being supplied to the tank 111 of the inkjet recording head 101, not only does it become impossible to carry out recording operations when the tank has run out of ink, but also the inkjet recording head body 118 may break.

SUMMARY OF THE INVENTION

Accordingly, it is an object of the present invention to provide an inkjet recording head and an inkjet recording device which, as in the related structure, use a needle to supply ink to a tank of the inkjet recording head, but which addresses the problem of solidification of ink which might otherwise clog the needle.

Thus, according to a first aspect of the invention, an inkjet recording head includes a tank divided into a large capacity main chamber and one or more needle-receiving chambers. Each needle receiving chamber includes a connection hole for connection with the main chamber, and further includes an opening for insertably receiving a needle for supplying ink into (or discharging air from) the needle receiving chamber. In an upright position corresponding to a position of use of the inkjet recording head, the connecting hole is situated above the opening.

Because the connecting hole is situated above the opening, even in a situation where the ink level in the main chamber falls below the opening, a pool of residual ink tends to form in the needle-receiving chamber. This pool of residual ink completely encloses the needle and its terminal hole, such that the needle itself is not generally exposed to air and rather is enclosed by ink. Since the needle is not exposed to air, solidification of ink and clogging of the needle are largely reduced as compared with prior art devices.

In particularly preferred forms, the opening of the needle-receiving chamber is sealed by a resilient joint through which the needle can pass, so as to sealingly close the needle-receiving chamber during time periods when the needle is not inserted. In addition, the connecting hole has a diameter sized so as to facilitate formation of a meniscus of ink, thereby increasing the stability of the pool of residual ink in the needle-receiving chamber.

In further preferred forms, two or more needle-receiving chambers are provided, such as first and second needle-receiving chambers with corresponding first and second openings and first and second connecting holes. The first needle-receiving chamber is disposed vertically above the second needle-receiving chamber, when the inkjet recording head is in the upright position. Air is discharged from the upper first needle-receiving chamber, and ink is supplied into the lower, second needle-receiving chamber.

According to further aspects, the invention provides an inkjet recording device utilizing an inkjet recording head according to the above-mentioned description.

According to the above-described structures, an ink supply path, used to supply ink to the inkjet recording head, with minimal ink leakage, can be formed with a simple and low-cost structure. In addition, even if the amount of ink inside the tank has decreased, so that there is almost no ink inside the tank, the whole needle or at least a portion of the needle near the periphery thereof, since it is disposed in the needle-receiving chamber, is immersed in the ink, and not exposed to air so that solidification of the ink in the hole of the needle is largely avoided.

According to a second aspect of the present invention, there is provided an inkjet recording device comprising any one of the above-described inkjet recording heads, and supply means for supplying ink to the tank through the needle which is inserted into the needle-receiving chamber.

The inkjet recording device may further comprise discharge means for discharging air from the tank through a needle inserted into a needle-receiving chamber.

When the inkjet recording device further comprises discharging means for discharging air from the tank, the needle for the ink supplying means and the needle for the discharging means may be inserted into different needle-receiving chambers; or they may be essentially inserted at the same time in the same needle-receiving chamber.

Further objects, features and advantages of the present invention will become apparent from the following description of the preferred embodiments with reference to the attached drawings.

DESCRIPTION OF THE PREFERRED EMBODIMENTS

Hereunder, a description of preferred embodiments of the present invention will be given with reference to the drawings.

First Embodiment

A description of a first embodiment of the present invention will be given in detail with reference to FIGS. 1 to 5.

Carriage Holding Structure

Figure 1:
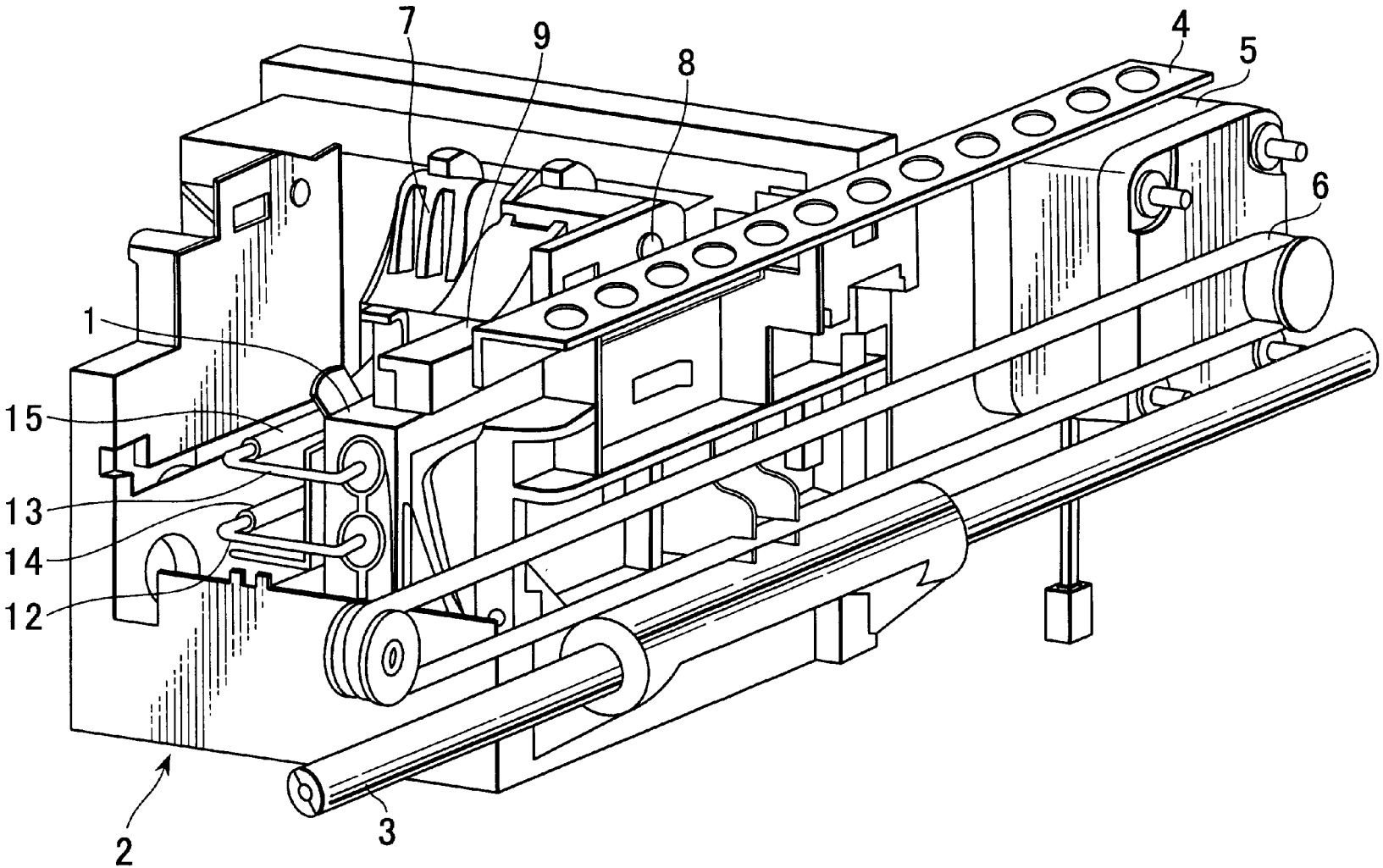
FIG. 1 is a perspective view of the main portion of an inkjet recording device of a first embodiment of the present invention.

An inkjet recording device of the first embodiment comprises an inkjet recording head 1, a carriage 2 for removably holding the inkjet recording head 1, and a frame (not shown) for holding the carriage 2. FIG. 1 is an external perspective view of the structure for holding the carriage 2. As shown in FIG. 1, the carriage 2 is slidably supported by a carriage shaft 3 and a guide rail 4, to which both end portions of the frame are secured. The carriage shaft 3 and the guide rail 4 are disposed parallel to each other. By a belt 6 which is driven by a carriage motor 5 secured to the frame, the carriage 2 reciprocates in a direction parallel to the carriage shaft 3 and the guide rail 4. The direction of movement of the carriage 2 is parallel to the direction in which ink-discharge nozzles (not shown) of the inkjet recording head 1 carried by the carriage 2 are arranged in a row.

Head Securing Portion of Carriage

Figure 2:
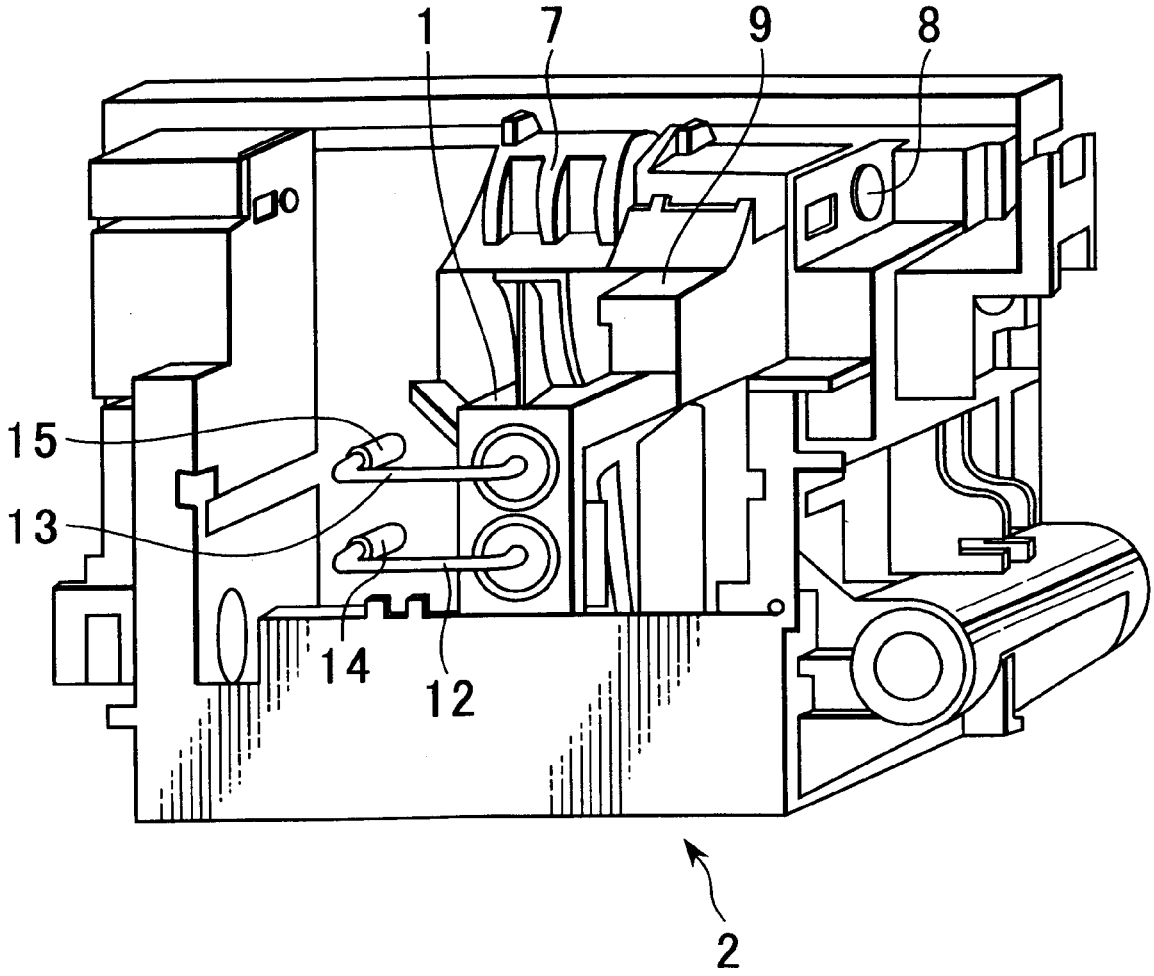
FIG. 2 is a perspective view of a carriage of the inkjet recording device shown in FIG. 1.

FIG. 2 is an external perspective view of the structure of the carriage 2. A head lever 7 is swingably supported at the top portion of the carriage 2 by a head lever shaft 8. A lever section 9 for swinging the head lever 7 is provided at the right side of the head lever 7.

In order to secure the inkjet recording head 1, a head lever plate (not shown) and a head lever spring (not shown), which is a compression spring for biasing the head lever plate, are attached to the head lever 7. Accordingly, the inkjet recording head 1 is secured to the carriage 2 while being held down at the lower back side of the carriage 2. A head connector (not shown) for sending and receiving signals to and from the inkjet recording head 1 is mounted to the back-side wall of the carriage 2. A plurality of contacts are provided at the head connector, and move separately towards the front and back. When the inkjet recording head 1 is mounted, the head connector and a contact portion (contact pad 10; see FIG. 3A)) of the inkjet recording head 1 (described later) come into electrical contact with each other, so that signals can be transmitted and received between the inkjet recording head 1 and the carriage 2. Although not shown, the head connector is connected to a control circuit of the body of the recording device through, for example, a flexible cable.

Ink Supplying Means and Air Discharging Means

As shown in FIG. 2, ink supplying means for supplying ink to a tank 11 of the inkjet recording head 1 (described later) and air discharging means for discharging air from the tank 11 are provided forwardly of the portion of the carriage 2 to which the inkjet recording head 1 is mounted. These mechanisms will be described below.

As shown in FIGS. 2, 4, and 5A to 5C, two needles 12 and 13 that are arranged vertically in a row are provided at the carriage 2.

The needles 12 and 13 are thin and hollow, and have U shapes and pipe forms. As shown in FIGS. 4 and 5A to 5C, one end portion of each of the needles 12 and 13 has a conical shape in which pipe diameters become gradually smaller. The tips of these end portions are closed. Small holes 12*a* and 13*a* are formed in the upper surfaces of the corresponding needles 12 and 13 near the tips thereof. Ink and air can circulate through the holes 12*a* and 13*a*. As shown in FIG. 2, the other ends of the needles 12 and 13 are connected to tubes 14 and 15, respectively. The tubes 14 and 15 are routed inside the carriage 2 and extend outside of the carriage 2.

The two needles 12 and 13 having such structures are provided. Of these needles 12 and 13, the lower needle 12 is connected to a main tank 16 through the tube 14. The upper needle 13 is connected to a pump 17 through the tube 15.

In other words, the pump 17, the tube 15, and the upper needle 13 form discharge means for suctioning air from inside the tank 11 of the inkjet recording head 1 (described later). The main tank 16, the tube 14, and the lower needle 12 form ink supplying means for supplying ink into the tank 11 of the inkjet recording head 1.

The tubes 14 and 15 are sufficiently flexible at the outer side of the tube-mounting locations of the carriage 2. Accordingly, the tubes 14 and 15 are formed so that excessive stress is not exerted thereupon when the carriage 2 moves.

Inkjet Recording Head

Figure 3A:
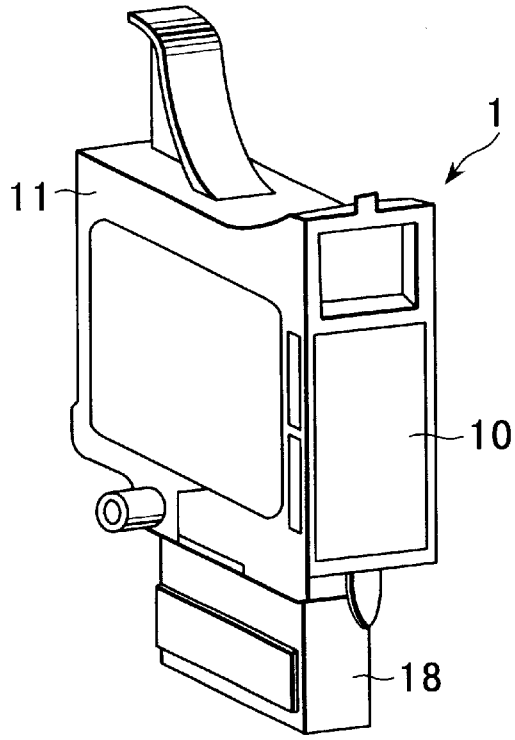
FIGS. 3A and 3B are perspective views of an inkjet recording head of the inkjet recording device of the first embodiment of the present invention.
Figure 3B:
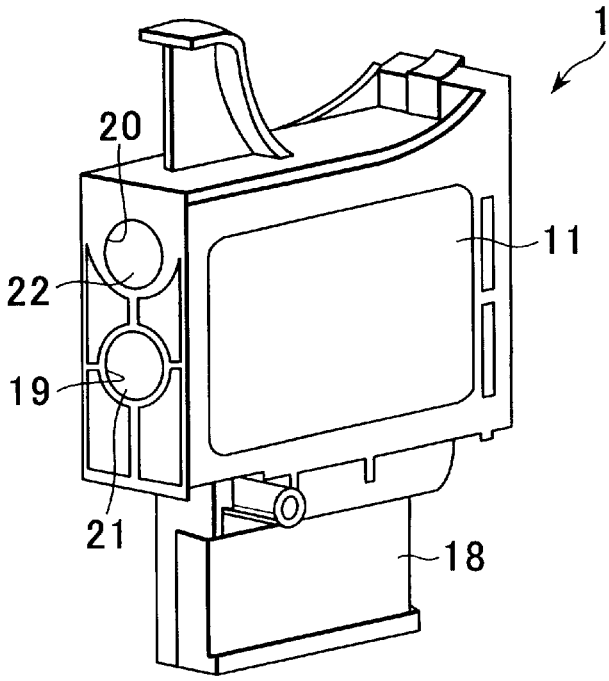
Figure 4:
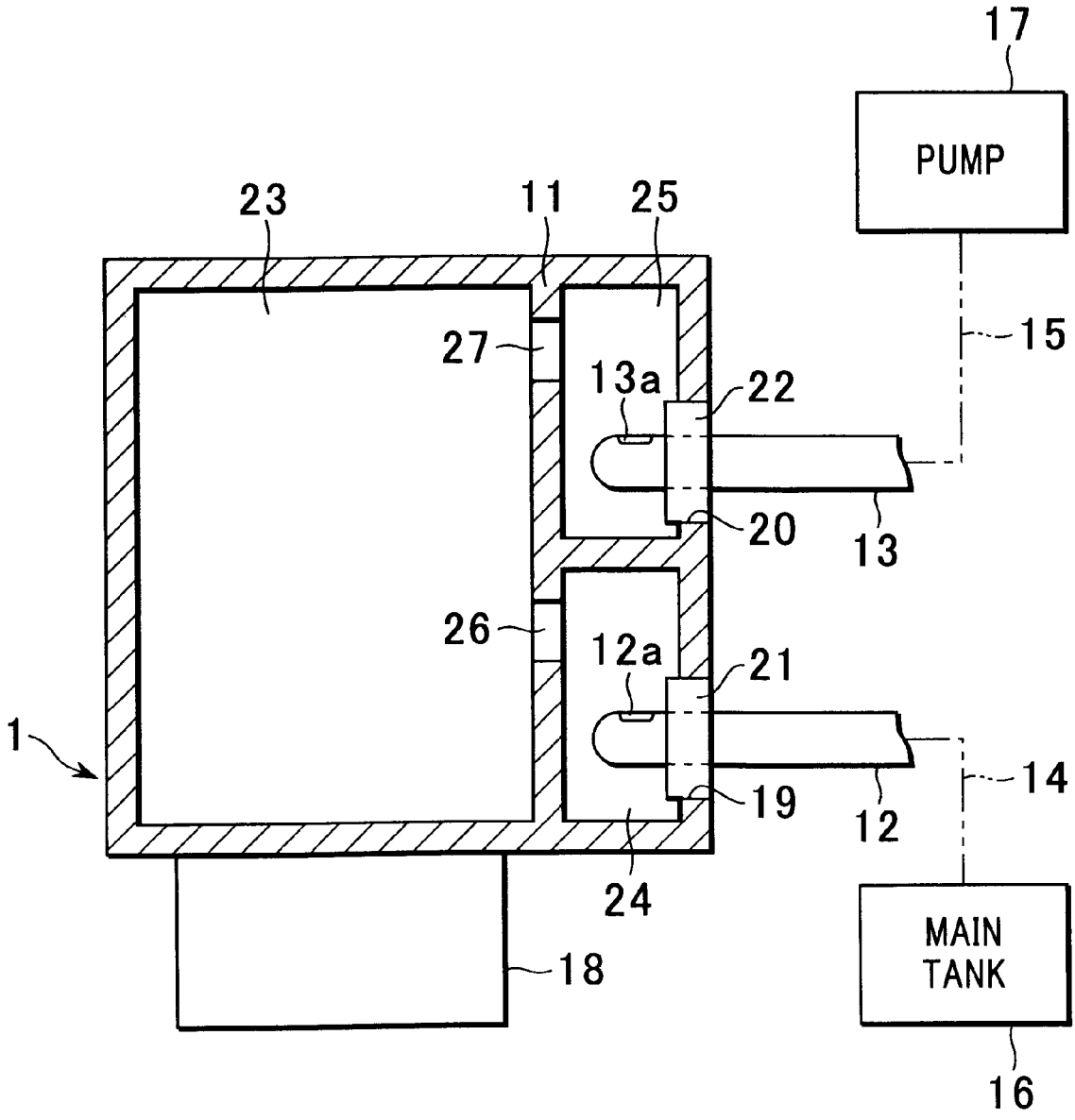
FIG. 4 is a schematic sectional view of the inkjet recording head of the inkjet recording device of the first embodiment of the present invention.

FIGS. 3A and 3B are external perspective views of the structure of the inkjet recording head 1. The head 1 comprises a contact pad 10 where an electrical wiring for transferring a recording signal between it and the body of the recording device is formed and which is formed by a flexible cable, TAB (Tape Automated Bonding), or the like; a recording head body (head chip) 18 from which droplets are discharged downwards in FIGS. 3A and 3B from an array of ink-discharge nozzles (not shown) in accordance with the recording signal; and the tank 11 for containing liquid, such as ink, supplied to the head chip 18. In this embodiment, the tank 11 also functions as a frame member for holding the head chip 18.

Since the head chip 18 and the tank 11 are connected by a connecting member (not shown), ink stored in the tank 11 is supplied to the head chip 18, and discharged from an ink-discharge nozzle of the head chip 18, whereby a recording operation is carried out.

Two openings 19 and 20 are formed in a surface of the inkjet recording head 1 opposite to the surface thereof where the contact pad 10 is disposed. Resilient joints (rubber stops) 21 and 22 are provided at the openings 19 and 20, respectively, so as to close them.

As shown in FIGS. 4 and 5A to 5C, the inside of the tank 11 is divided into three chambers. These views show tank 11 in an upright position corresponding to a position of use. More specifically, the tank 11 is divided into a main chamber 23 of relatively larger capacity and two smaller capacity needle receiving chambers 24 and 25. The main chamber 23 has a large capacity, is the main portion of the tank 11, and stores a large portion of ink. The needle-receiving chambers 24 and 25 receive the two needles 12 and 13, respectively. The two needle-receiving chambers 24 and 25 are arranged vertically in a row at the surface of the inkjet recording head 1 opposite to the surface thereof where the contact pad 10 is disposed. The openings 19 and 20 where the corresponding resilient joints 21 and 22 are provided are formed at the two needle-receiving chambers 24 and 25, respectively. In other words, the openings 19 and 20 and the resilient joints 21 and 22 are formed in side walls of the needle-receiving chambers 24 and 25, respectively.

The main chamber 23 and the lower needle-receiving chamber 24 are connected by a connecting hole 26, and the main chamber 23 and the upper needle-receiving chamber 25 are connected by a connecting hole 27. The connecting hole 26 is disposed above the opening 19 of the needle-receiving chamber 24, and the connecting hole 27 is disposed above the opening 20 of the needle-receiving chamber 25.

In the embodiment, the needles 12 and 13, the openings 19 and 20, and the resilient joints 21 and 22 have the same structures, respectively. The outer diameters of the resilient joints 21 and 22 are larger than the inside diameters of the openings 19 and 20, respectively. The resilient joints 21 and 22 are press-fitted in the corresponding openings 19 and 20 while they are in a compressed state. The resilient joints 21 and 22 are resilient members formed of, for example, rubber, and are constructed so that the needles 12 and 13 can be inserted into them, respectively. The resilient joints 21 and 22 are formed so that, when the needles 12 and 13 are inserted into the corresponding resilient joints 21 and 22, the needles 12 and 13 pass through the corresponding resilient joints 21 and 22 and are inserted into the corresponding needle-receiving chambers 24 and 25 of the tank 11. In the inserted state, the needles 12 and 13 are subjected to a strong gripping force (compression force towards the outer peripheral portions of the needles 12 and 13) by the resilient joints 21 and 22. Accordingly, by the insertion of the needles 12 and 13, holes formed in the resilient joints 21 and 22 and the outer peripheries of the needles 12 and 13 are in close contact with each other without any gaps. Consequently, they are completely sealed so as not to allow leakage of ink or the like. When the needles 12 and 13 are pulled out of the corresponding resilient joints 21 and 22, a compression force is exerted on the resilient joints 21 and 22, so that the holes formed in the resilient joints 21 and 22 are immediately closed, as a result of which the tank 11 is hermetically sealed.

Ink Supply Path and Air Discharge Path

Next, a description of an ink supply path and an air discharge path in the ink supplying means and the air discharging means and the inkjet recording head 1 having the above-described structures will be described in detail below.

The ink supply path is formed by inserting the needle 12, connected from the main tank 16 secured to the body of the recording device (not shown) through the tube 14, into the needle-receiving chamber 24 of the tank 11 as a result of inserting the needle 12 through the resilient joint 21 closing the opening 19.

On the other hand, the air discharge path is formed by inserting the needle 13, connected to the pump 17 secured to the body of the recording device through the tube 15, into the needle-receiving chamber 25 of the tank 11 as a result of inserting the needle 13 through the resilient joint 22 closing the opening 20.

As described above, in the inkjet recording head 1, even a very small amount of air mixed in the ink gradually accumulates, and very small amounts of air can pass through, for example, the wall of the tube 14 and gradually accumulate in the entire ink path. Therefore, the amount of ink in the tank 11 gradually decreases. Changes in the amount of ink in the tank 11, that is, in the three chambers 23, 24, and 25 of the tank 11 in the embodiment, will be illustrated with reference to FIGS. 5A to 5C.

Figure 5A:
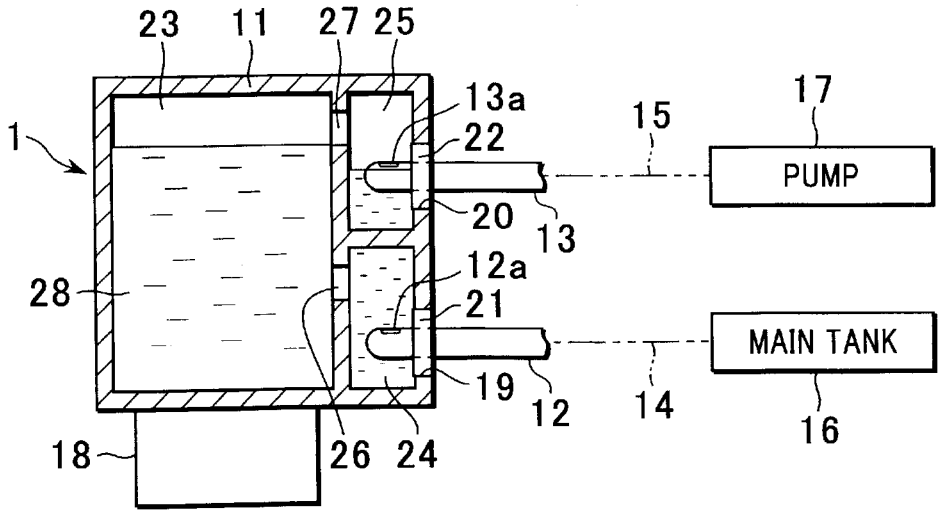
FIGS. 5A to 5C are schematic sectional views showing changes in the amount of ink in the inkjet recording head of the inkjet recording device of the first embodiment of the present invention.

FIG. 5A shows a state in which a sufficient amount of the ink 28 is accumulated in the tank 11 of the inkjet recording head 1. Here, the ink 28 is sufficiently accumulated in the main chamber 23 occupying a large volume of the tank 11. The needle-receiving chamber 24 into which the lower needle 12 has been inserted is filled with the ink 28. In other words, the ink 28 fills the needle-receiving chamber 24 to a level above the opening 19 to which the needle 12 is inserted and above the connecting hole 26 connecting the needle-receiving chamber 24 and the main chamber 23. Therefore, the whole needle 12 is immersed in the ink 28, so that the ink 28 is present at the inside and outside of the hole 12*a* formed near an end of the needle 12.

On the other hand, the ink 28 fills the needle-receiving chamber 25 into which the upper needle 13 has been inserted to a level about half its capacity. The surface of the ink 28 is at a height equal to that of the opening 20 into which the needle 13 has been inserted, and is located below the connecting hole 27. More specifically, the ink 28 is accumulated to a level just below the hole 13*a* of the inserted needle 13.

When a recording operation is carried out in this state, so that negative pressure is produced in the tank 11 by consumption of the ink 28 inside the main chamber 23 due to ink discharge, ink 28 is supplied to the needle-receiving chamber 24 through the tube 14 and the needle 12 from the main tank 16 until the pressure returns to its original value. When the ink 28 flows into the needle-receiving chamber 24, the ink 28 flows into the main chamber 23 through the connecting hole 26. In an ordinary recording operation, the main ink-containing tank 23 is always replenished with ink 28.

Figure 5B:
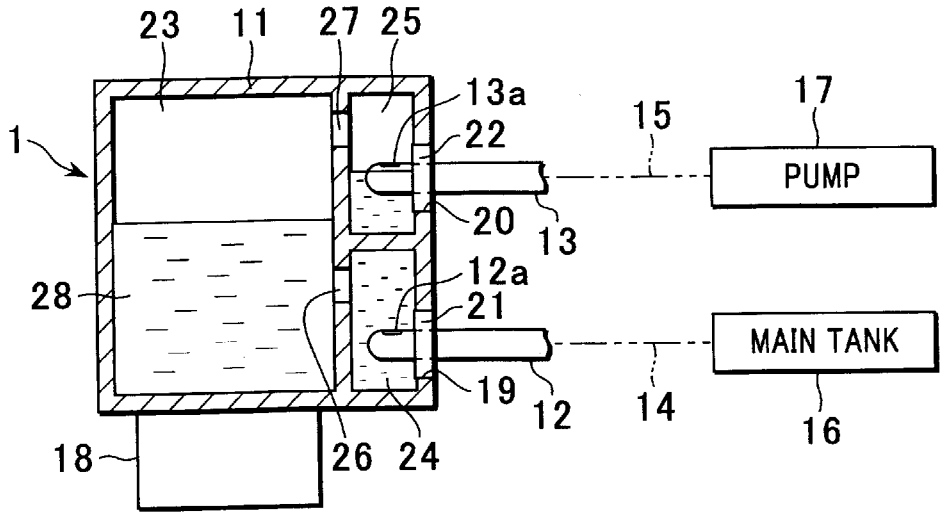

While the ink 28 is being consumed and the main chamber 23 is being replenished with the ink 28, air gradually accumulates in the tank 11 of the inkjet recording head 1, so that, while the pressure is maintained at approximately a constant value, the amount of ink 28 may decrease from the amount shown in FIG. 5A due to an increase in the amount of air. FIG. 5B illustrates a state in which the amount of ink 28 in the main chamber 23 of the tank 11 is reduced to about half its original amount.

In this state, since the surface of the ink 28 inside the main chamber 23 is positioned above the needle-receiving chamber 24 and the connecting hole 26, the needle-receiving chamber 24 is still completely filled with the ink 28.

On the other hand, although the surface of the ink 28 inside the main chamber 23 is situated considerably below the connecting hole 27 connecting the main chamber 23 to the needle-receiving chamber 25, the surface of the ink 28 inside the needle-receiving chamber 25 is also situated below the connecting hole 27, so that there is no movement of the ink 28 between the needle-receiving chamber 25 and the main chamber 23, as a result of which the amount of ink 28 inside the needle-receiving chamber 25 does not change from that shown in FIG. 5A. Since the opening 20 of the needle-receiving chamber 25 is located below the connecting hole 27, the ink 28 remains accumulated to the level just below the hole 13*a* of the inserted needle 13.

In other words, the amount of ink 28 decreases only in the main chamber 23, so that the amounts of the ink 28 inside the needle-receiving chambers 24 and 25 are kept the same at the levels shown in FIG. 5A.

Therefore, the whole needle 12 is immersed in the ink 28, and the needle 13 is immersed in the ink 28 to a portion thereof just below the hole 13*a*.

Figure 5C:
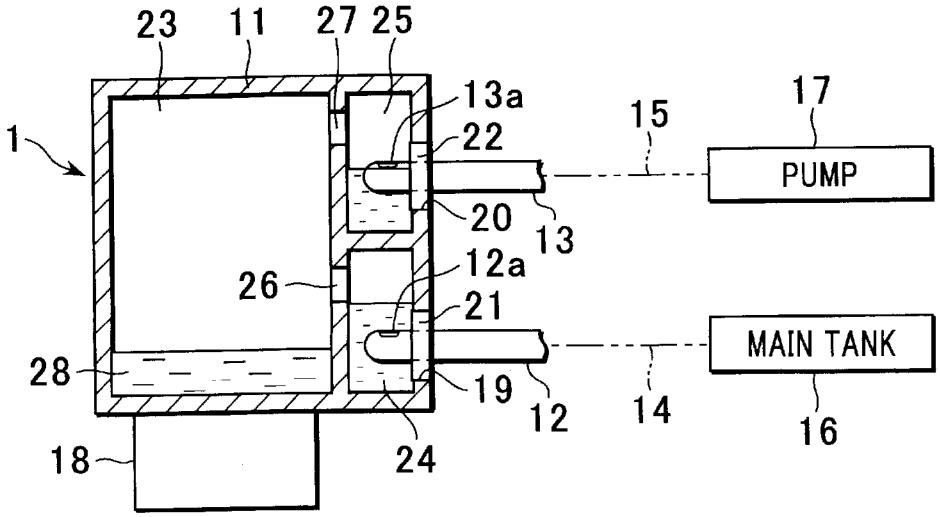

When the amount of ink 28 further decreases, so that the surface of the ink 28 inside the main chamber 23 reaches a level below the connecting hole 26 connecting the main chamber 23 to the needle-receiving chamber 24, the ink 28 inside the needle-receiving chamber 24 flows into the main chamber 23. FIG. 5C shows a state in which there is almost no ink 28 inside the main chamber 23 due to the further decrease in the amount of ink 28.

The flowing of the ink 28 into the main chamber 23 from the needle-receiving chamber 24 described above stops when the surface of the ink 28 inside the needle-receiving chamber 24 reaches a level below the connecting hole 26. Thereafter, when the amount of ink 28 further decreases, there is almost no ink 28 inside the main chamber 23. However, there is no movement of the ink 28 between the main chamber 23 and the needle-receiving chambers 24 and 25. Therefore, the needle-receiving chamber 24 is kept filled with the ink 28 to a level near the bottom edge of the connecting hole 26. Since the connecting hole 26 is located above the opening 19 into which the needle 12 has been inserted, the whole needle 12 remains immersed in a pool of residual ink in the chamber 24. There is no change in the amount of ink 28 inside the needle-receiving chamber 25 from that shown in FIGS. 5A and 5B, so that the needle 13 remains immersed in the ink 28 to a portion thereof just below the hole 13*a*.

Even if the main chamber 23 used for ink discharge runs out of the ink 28 as a result of consumption of the ink 28 inside the tank 11 of the inkjet recording head 1, ink 28 still remains inside the needle-receiving chambers 24 and 25. Either the whole of each of the needles 12 and 13 or up to at least a portion of each of the needles 12 and 13 just below each of its corresponding holes 12*a* and 13*a* formed near an end of each of the needles 12 and 13 is immersed in the ink 28.

By this, when portions of the needles 12 and 13 up to locations just below the corresponding holes 12*a* and 13*a*, not to mention the whole needles 12 and 13, are in contact with the ink 28, the ink 28 is also always present near the holes 12*a* and 13*a*. Therefore, since the ink 28 on the inside of or near the inside of each of the holes 12*a* and 13*a* are wet due to contact with surrounding ink 28, there is no possibility of the holes 12*a* and 13*a* becoming clogged by dried and solidified ink 28. The ink and air are always in flowable states through the needles 12 and 13, so that the ink 28 can always be smoothly supplied to the inkjet recording head 1. Consequently, recording failure and breakage of the inkjet recording head 1 do not occur.

Ink Supplying Operation

For supplying the ink 28 to the tank 11 of the inkjet recording head 1, an ink level sensor (not shown) is provided inside the tank 11. Using the ink level sensor, the supplying of ink 28 may be carried out at a timing in which the state shown in FIG. 5C where there is almost no ink left, or periodically after completion of a recording operation, or after a power supply has been turned on. A description of an ink supplying operation in the embodiment will be given below.

When, as shown in FIG. 5C, there is almost no ink 28 left in the main chamber 23 used to store the ink 28 of the tank 11 of the inkjet recording head 1, an ink supplying operation is carried out.

In supplying ink, the pump 17 is operated in order to suction air from the needle-receiving chamber 25 through the tube 15 and the upper needle 13. When the air is suctioned from the needle-receiving chamber 25, air inside the main chamber 23 is also suctioned through the connecting hole 27. In addition, air inside the needle-receiving chamber 24 is also suctioned through the connecting hole 26. By these suctioning operations, the pressure in the whole hermetically sealed tank 11 becomes negative. By suction force produced by the negative pressure, the ink 28 in the main tank 16 is suctioned through the lower needle 12 and the tube 14. When ink flows into the needle-receiving chamber 24, the main chamber 23 becomes filled with the ink through the connecting hole 26 from the needle-receiving chamber 24. After a while, a sufficient amount of ink fills the inside of the tank 11 of the inkjet recording head 1. The ink 28 fills the inside of the main chamber 23 to a portion thereof above the connecting hole 27, so that the ink 28 flows to the needle-receiving chamber 25 through the connecting hole 27.

When the ink 28 fills the main chamber 23 by an amount of the order of the amount shown in FIG. 5A, the amount of ink 28 is sufficient, so that the ink supply is stopped.

In the case where an ink level sensor (not shown) for detecting the amount of ink is provided inside the main chamber 23, when the ink level sensor detects that the amount of ink has reached a reference value (for example, the amount of ink shown in FIG. 5A), the ink supplying operation can be completed by immediately stopping the operation of the pump 17.

In contrast, when an ink level sensor for detecting the amount of ink is not provided, an amount of ink which is equivalent to the entire volume of the tank 11 is periodically supplied. This can reliably prevent the problem of insufficient ink from occurring, but may give rise to the problem that ink is supplied even when the amount of ink has not decreased to the amount shown in FIG. 5C. In such a case, even if a sufficient amount of ink is provided as shown in FIG. 5A, the pump 17 continues sucking air through the tube 15 and the upper needle 13. This causes suction of air in the tank 11 to finish immediately, after which suction and discharge of the ink 28 are started. When an amount of ink approximately equivalent to the whole volume of the tank 11 is supplied, the operation of the pump 17 is stopped, so that the ink supplying operation is completed. In this structure, not only air, but also a large amount of ink 28 is sucked out from the tank 11. Therefore, this structure has a disadvantage in that the ink 28 is wastefully consumed when the ink 28 is discharged as waste ink. To prevent this, the inkjet recording head 1 may be constructed so that the ink 28 sucked out by the pump 17 is reused by returning it to the main tank 16. In either of these cases, an ink level sensor is not required, so that these structures have the advantage of reduced costs.

Second Embodiment

Hereunder, a description of a second embodiment of the present invention will be given. Only component parts that are different from those of the first embodiment will be described.

Figure 6:
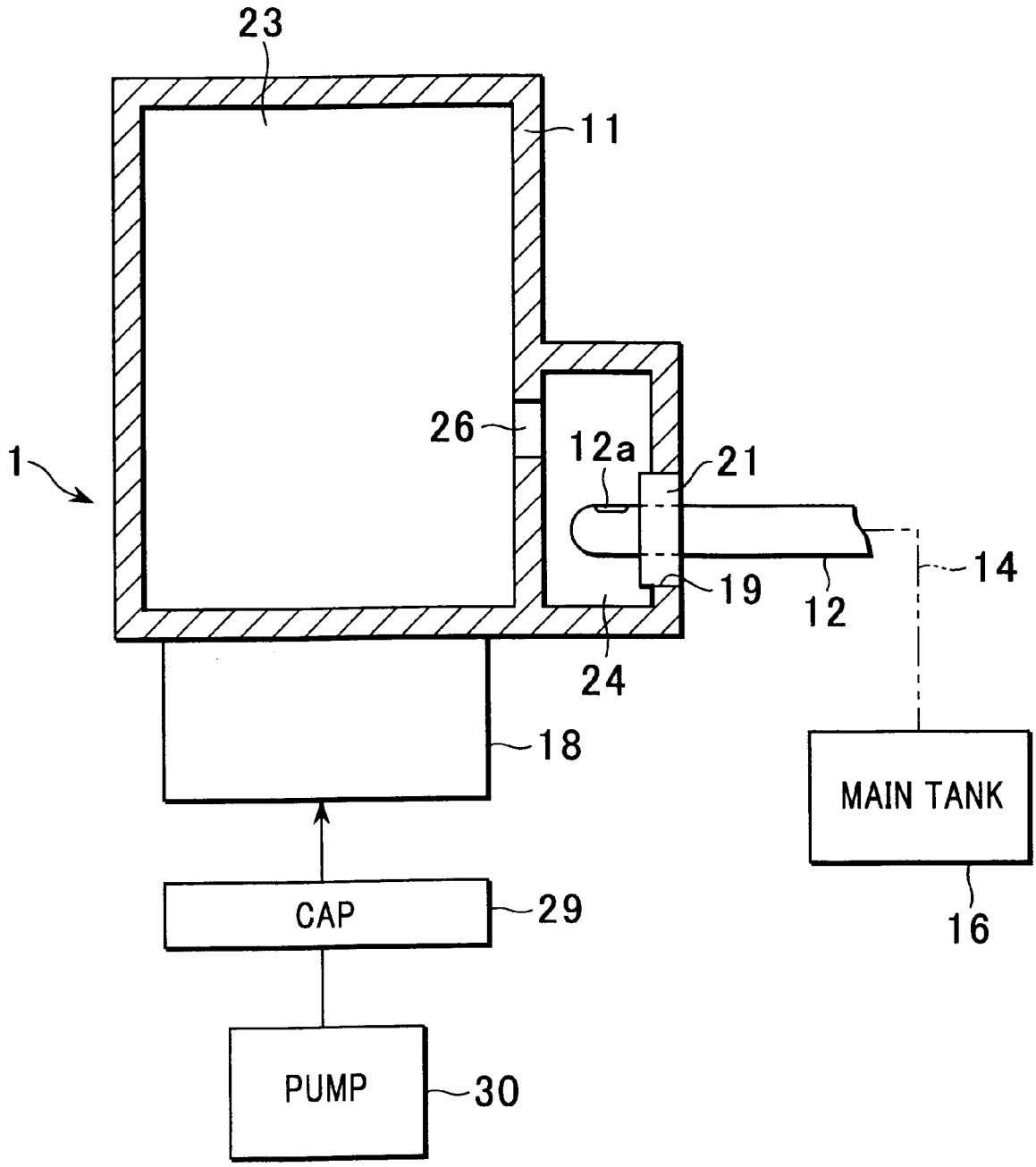
FIG. 6 is a schematic sectional view of an inkjet recording head of an inkjet recording device of a second embodiment of the present invention.
Figure 7A:
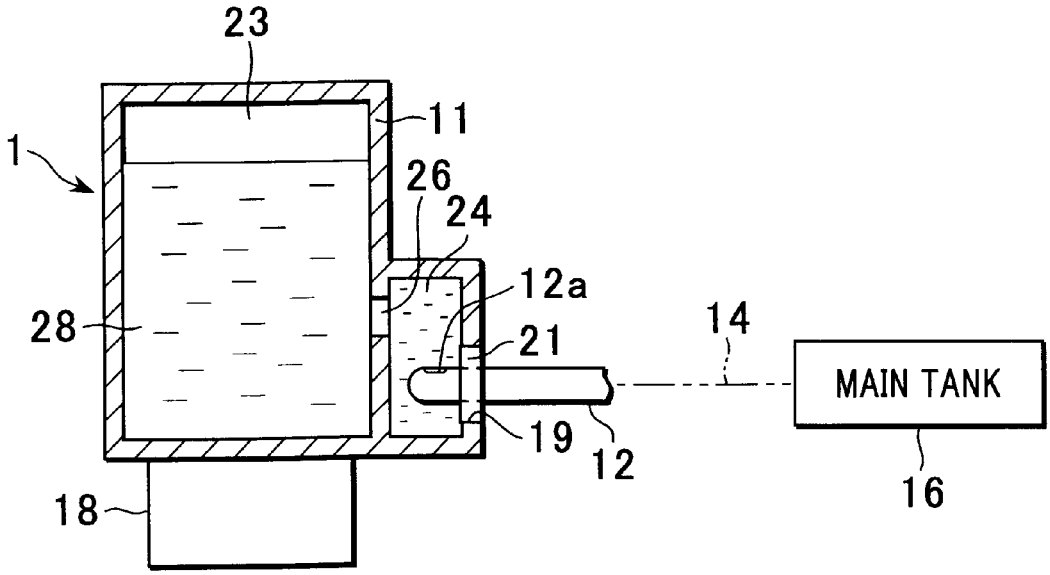
FIGS. 7A and 7B are schematic sectional views showing changes in the amount of ink in the inkjet recording head of the inkjet recording device of the second embodiment of the present invention.
Figure 7B:
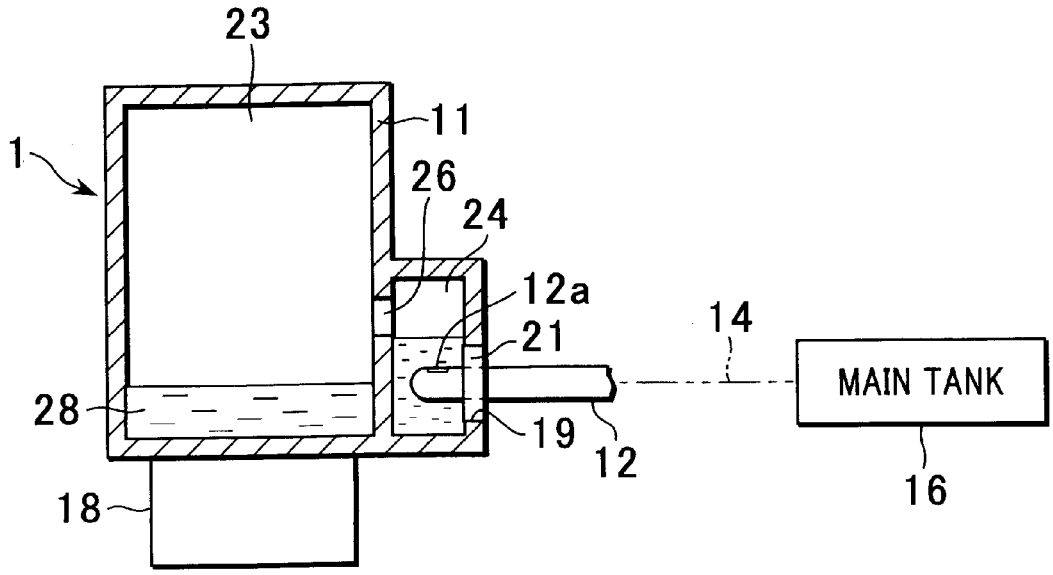
Figure 8A:
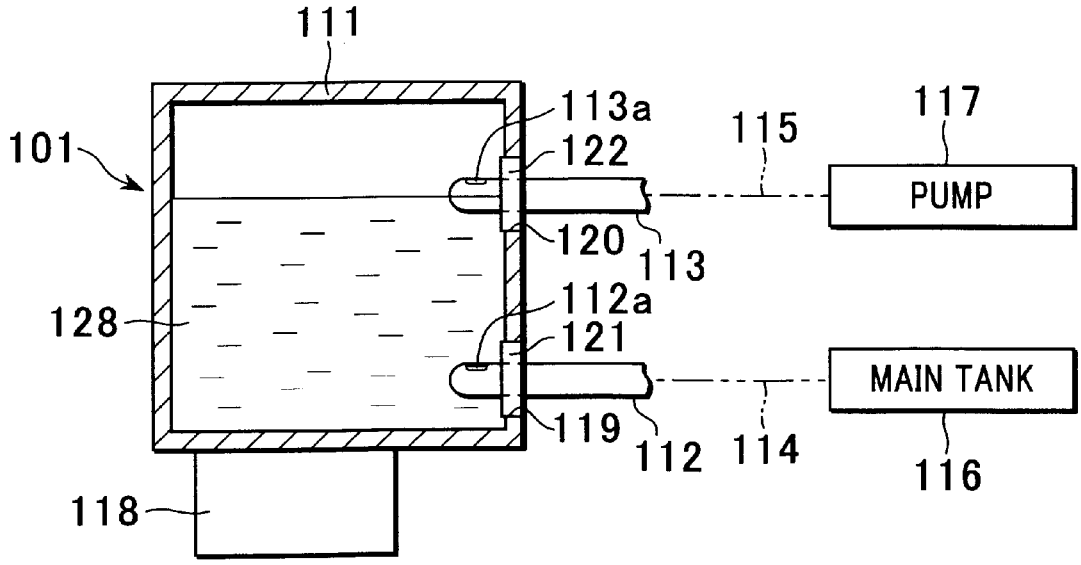
FIG.8A PRIOR ART
FIGS. 8A and 8B are schematic sectional views showing changes in the amount of ink in a related inkjet recording head.
Figure 8B:
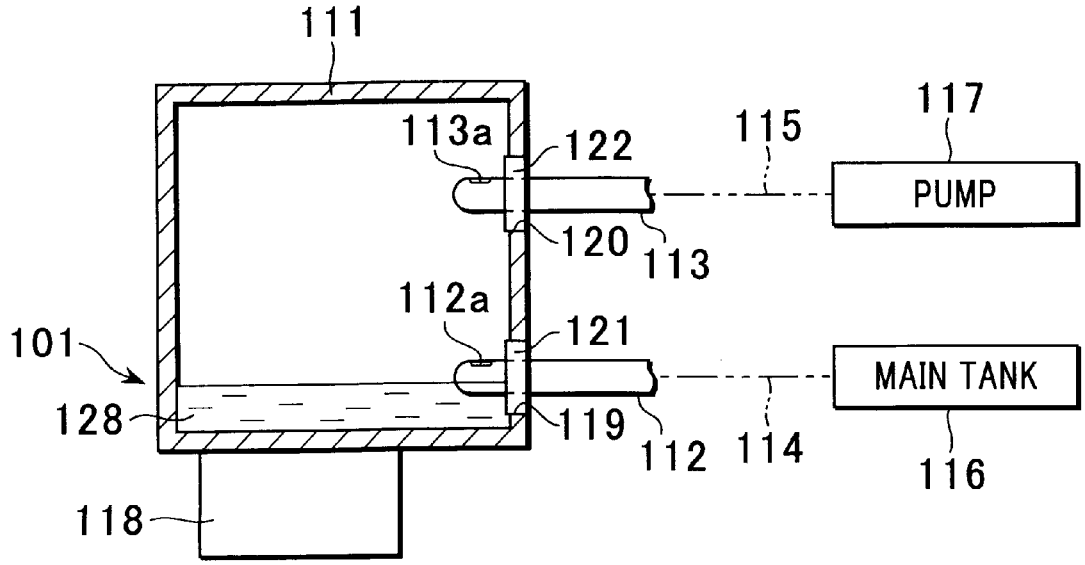
FIG.8B PRIOR ART

In the second embodiment, as shown in FIG. 6 and FIGS. 7A and 7B, a tank 11 is divided into a main chamber 23 and a single needle-receiving chamber 24. The main chamber 23 has a large capacity, is the main portion of the tank 11, and is used to store a large portion of ink. The needle-receiving chamber 24 has a small capacity and has one needle 12 inserted into it. A single opening 19 is formed in the needle-receiving chamber 24, and is closed by a resilient joint 21. The main chamber 23 and the needle-receiving chamber 24 are connected by a connecting hole 26, which is located above the opening 19.

Ink supplying means comprising a main tank 16, a tube 14, and the needle 12 and having the same structure as that of the first embodiment is provided, but a second needle-receiving chamber is not provided. However, a cap 29 for covering a discharge nozzle of head chip 18 and a pump 30 which can suck and discharge air and ink 28 inside an inkjet recording head 1 through the cap 29 are provided. These component parts operate similarly to the air-discharging means used in the first embodiment.

In the embodiment, when a sufficient amount of ink 28 is accumulated in the tank 11 of the inkjet recording head 1, as shown in FIG. 7A, the ink 28 is sufficiently accumulated in the main chamber 23, and a relatively large amount of ink 28 is also accumulated in the needle-receiving chamber 24 to a level above the connecting hole 26. Therefore, the whole needle 12 is immersed in the ink 28, so that the ink 28 is present at the inside and outside of a hole 12*a* of the needle 12 formed near an end thereof.

FIG. 7B shows a state in which there is almost no ink 28 left inside the main chamber 23 as a result of a decrease in the amount of ink 28 afterwards. Even here, the needle-receiving chamber 24 is kept filled with the ink 28 to a level up to a level near the bottom edge of the connecting hole 26. Since the connecting hole 26 is located above the opening 19 to which the needle 12 is inserted, the whole needle 12 remains immersed in a pool of residual ink.

Accordingly, since the whole needle 12 used in the second embodiment is kept in contact with the ink 28 at all times regardless of the amount of ink inside the main chamber 23, there is no possibility of the hole 12*a* getting clogged due to solidification of the ink 28 near the hole 12*a*. The ink 28 is always in a flowable state through the needle 12, so that the ink 28 can always be smoothly supplied to the inkjet recording head 1. Consequently, recording failure and breakage of the inkjet recording head 1 do not occur.

Third Embodiment

A description will now be given of a third embodiment of the present invention. Only structural features that differ from those of the first embodiment will be described.

In the first embodiment, the main chamber 23 and the lower needle-receiving chamber 24 are connected by the connecting hole 26, and the main chamber 23 and the upper needle-receiving chamber 25 are connected by the connecting hole 27. The connecting hole 26 is situated above the opening 19 of the needle-receiving chamber 24, and the connecting hole 27 is situated above the opening 20 of the needle-receiving chamber 25.

In the third embodiment, attention is paid to the surface tension of ink and the diameters of connecting holes 26 and 27. In the third embodiment, by reducing the sizes of the connecting holes 26 and 27, a meniscus of ink 28 is formed at the connecting holes 26 and 27 by the surface tension of the ink 28 even if the ink level inside a main chamber 23 becomes low. More than a single connecting hole can be provided for each needle-receiving chamber, so as to maintain sufficient flow therethrough.

When the structure is such as to form a meniscus of ink at the connecting holes 26 and 27, the ink 28 does not flow out from needle-receiving chambers 24 and 25 into the main chamber 23 regardless of the positions of the connecting holes 26 and 27 at the corresponding needle-receiving chambers 24 and 25, so that it is possible to keep needles 12 and 13 immersed in the ink 28.

In this way, when the diameters of the connecting holes 26 and 27 are made small so as to allow formation of a meniscus of ink, it is not strictly necessary to position the connecting holes 26 and 27 above openings 19 and 20 of the corresponding needle-receiving chambers 24 and 25, although that arrangement is preferred. Because of the size of the connecting holes, regardless of where the connecting holes 26 and 27 are disposed (such as below the openings 19 and 20 of the corresponding needle-receiving chambers 24 and 25), the objects of the present invention can be achieved.

In other words, regardless of the amount of ink inside the main chamber 23, the whole needles 12 and 13 are kept in contact with the ink 28 at all times, so that there is no possibility of the holes 12*a* and 13*a* becoming clogged due to solidification of the ink 28 near the holes 12*a* and 13*a*. The ink 28 and air are always in flowable states through the needles 12 and 13, so that the ink 28 can always be smoothly supplied to the inkjet recording head 1. Consequently, recording failure and breakage of the inkjet recording head 1 do not occur.

As described above, according to the present invention, since resilient joints into which needles are inserted are provided at the tank of the inkjet recording head, it is possible to provide an ink supply path which has a simple and low-cost structure and which does not allow ink leaks. In addition, it is possible to allow circulation of ink and air without solidification of the ink inside or near the inside of the holes of the needles when the amount of ink is reduced. Therefore, it is possible to prevent recording failure and breakage of the inkjet recording head.

In an apparatus, such as an inkjet recording device which can perform color recording, including a plurality of tanks for using a plurality of types of ink, a plurality of the tanks having the structure of the tank 11 used in the first embodiment or the structure of the tank 11 used in second embodiment may be separately disposed in a row.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording device comprising:

an inkjet recording head having an upright position corresponding to a position in use thereof, said inkjet recording head including a tank for containing ink, the tank being divided into plural chambers including at least first and second needle-receiving chambers together with corresponding first and second openings and first and second connecting holes, and at least one main chamber whose capacity is larger than said first and second needle-receiving chambers, said main chamber and each of said needle-receiving chambers being connected through corresponding ones of said connecting holes therebetween;

discharge means for discharging air from the tank through a first needle insertable through said first opening into said first needle-receiving chamber;

supply means for supplying ink to said tank of said inkjet recording head, said supply means including a second needle which is insertable through said second opening into said second first needle-receiving chamber; and wherein in the upright position, the each connecting hole is situated above its corresponding opening.

2. An inkjet recording device according to claim 1, wherein the first and second openings are closed by a resilient joint through which the first and second needles respectively can pass.

3. An inkjet recording device according to claim 2, wherein neither of said first and second needles is insertable into said main chamber.

4. An inkjet recording device according to claim 1, wherein, when a large amount of ink is supplied to said second needle-receiving chamber the ink flows from said second needle-receiving chamber to said main chamber through the second connecting hole.

5. An inkjet recording device according to claim 1, wherein, when the amount of ink inside said main chamber decreases, the ink flows from said second needle-receiving chamber to said main chamber through the second connecting hole in order to replenish the main chamber with ink.

6. An inkjet recording device according to claim 1, wherein each of said first and second connecting hole has an opening diameter that allows formation of a meniscus of the ink.

7. An inkjet recording device according to any one of claims 1 to 6, wherein said first needle-receiving chamber is disposed vertically above said second needle-receiving chamber in the upright position.

8. An inkjet recording device according to any one of claims 1 to 6, wherein said first and second needles are essentially inserted at the same time in said first and second needle-receiving chambers.

9. An inkjet recording head having an upright position corresponding to a position in use thereof, comprising:

a tank for containing ink, the tank being divided into plural chambers including at least first and second needle-receiving chambers together with corresponding first and second openings and first and second connecting holes, and at least one main chamber whose capacity is larger than said first and second needle-receiving chambers, said main chamber and each of said needle-receiving chambers being connected through corresponding ones of said connecting holes therebetween, wherein each of said first and second openings is constructed for insertably receiving a needle for supplying ink into or discharging air from said needle-receiving chamber, and wherein in the upright position, each connecting hole is situated above its corresponding opening.

10. An inkjet recording head according to claim 9, wherein said first needle-receiving chamber is disposed vertically above said second needle-receiving chamber in the upright position.

11. An inkjet recording device comprising:

an inkjet recording head having a tank for containing ink, the tank being divided into plural chambers including at least first and second needle-receiving chambers together with corresponding first and second openings and first and second connecting holes, and at least one main chamber whose capacity is larger than said first and second needle-receiving chambers, said main chamber and each of said needle-receiving chambers being connected through corresponding ones of said connecting holes therebetween;

discharge means for discharging air from the tank through a first needle insertable through said first opening into said first needle-receiving chamber, and supply means for supplying ink to said tank of said inkjet recording head, said supply means including a second needle which is insertable through said second opening into said second needle-receiving chamber;

wherein each of said first and second connecting hole is sized small so as to allow formation of a meniscus of ink.

12. An inkjet recording device according to claim 11, wherein the first and second openings are closed by a resilient joint through which the first and second needles respectively can pass.

13. An inkjet recording device according to claim 12, wherein neither of said first and second needles is insertable into said main chamber.

14. An inkjet recording device according to claim 11, wherein, when a large amount of ink is supplied to said second needle-receiving chamber the ink flows from said second needle-receiving chamber to said main chamber through the second connecting hole.

15. An inkjet recording device according to claim 11, wherein, when the amount of ink inside said main chamber decreases, the ink flows from said second needle-receiving chamber to said main chamber through the second connecting hole in order to replenish the main chamber with ink.

16. An inkjet recording device according to claim 11, wherein said inkjet recording head has an upright position corresponding to a use position thereof, and wherein in the upright position, the each connecting hole is situated above its corresponding opening.

17. An inkjet recording device according to any one of claims 11 to 16, wherein said first needle-receiving chamber is disposed vertically above said second needle-receiving chamber in the upright position.

18. An inkjet recording device according to any one of claims 11 to 16, wherein said first and second needles are essentially inserted at the same time in said first and second needle-receiving chambers.

19. An inkjet recording head comprising:

a tank for containing ink, the tank being divided into plural chambers including at least first and second needle-receiving chambers together with corresponding first and second openings and first and second connecting holes, and at least one main chamber whose capacity is larger than said first and second needle-receiving chamber, said main chamber and each of said needle-receiving chambers being connected through corresponding ones of said connecting holes therebetween, wherein each of said first and second openings is constructed for insertably receiving a needle for supplying ink into or discharging air from said needle-receiving chamber, and wherein each of said first and second connecting hole is sized small so as to allow formation of a meniscus of ink.

20. An inkjet recording head according to claim 19, wherein said first needle-receiving chamber is disposed vertically above said second needle-receiving chamber.

* * * * *

UNITED STATES PATENT AND TRADEMARK OFFICE

CERTIFICATE OF CORRECTION

PATENT NO. : 6,722,761 B2
DATED : April 20, 2004
INVENTOR(S) : Shinya Asano et al.

It is certified that error appears in the above-identified patent and that said Letters Patent is hereby corrected as shown below:

Column 5,
Line 58, “FIG.3A))” should read -- FIG. 3A) --.

Column 9
Line 56, “which:” should be deleted.

Column 12,
Line 62, “first” should be deleted.

Column 13,
Line 17, “hole” should read -- holes --.

Column 14,
Line 6, “hole” should read -- holes --;
Line 48, “chamber,” should read -- chambers, --; and
Line 56, “hole” should read -- holes --.

Signed and Sealed this

Third Day of May, 2005

JON W. DUDAS
*Director of the United States Patent and Trademark Office*